United States Patent [19]

Switlik, Jr.

[11] 4,216,559

[45] Aug. 12, 1980

[54] LIFE RAFT HAVING A TOROIDAL WATER BALLAST CHAMBER

[76] Inventor: Richard Switlik, Jr., Box 1328, Trenton, N.J.

[21] Appl. No.: 874,181

[22] Filed: Feb. 2, 1978

[51] Int. Cl.[2] ..... B63C 9/04

[52] U.S. Cl. ..... 9/11 R; 9/11 A; 114/125

[58] Field of Search ..... 9/1.3, 2 A, 3, 4 R, 9/4 A, 11 R, 11 A, 5, 14; 114/121, 122, 123, 125; 272/1 B

[56] References Cited

U.S. PATENT DOCUMENTS

| | | | |
|---|---|---|---|
| 2,390,199 | 12/1945 | Walsh | 9/11 A X |
| 2,858,790 | 11/1958 | Russell, Jr. | 272/1.8 X |
| 3,034,154 | 5/1962 | Silverstone | 9/11 A |
| 3,060,465 | 10/1962 | Carstensen | 9/14 |
| 3,092,854 | 6/1963 | Manhart | 9/11 A |
| 3,155,992 | 11/1964 | Shewmake et al. | 9/11 A |
| 3,344,764 | 10/1967 | Ziermann | 9/1.3 X |
| 3,371,640 | 3/1968 | Tsokalas | 9/11 R X |
| 3,736,607 | 6/1973 | Radnofsky et al. | 9/2 A |
| 3,883,913 | 5/1975 | Givens | 9/11 A |
| 4,001,905 | 1/1977 | Givens | 9/11 A |

FOREIGN PATENT DOCUMENTS

| | | | |
|---|---|---|---|
| 28-2380 | 5/1953 | Japan . | |
| 788338 | 12/1957 | United Kingdom | 9/11 A |

*Primary Examiner*—Trygve M. Blix
*Assistant Examiner*—Winston H. Douglas
*Attorney, Agent, or Firm*—Frederick A. Zoda; John J. Kane; Albert Sperry

[57] ABSTRACT

A life raft, having a floor joined at its periphery to a flotation member, is formed with a flexibly-walled, depending, correspondingly water ballast chamber generally parallel and contiguous to the flotation member. The chamber may be compartmented for retention of the water ballast as a distributed stabilizing mass, and extends about a wholly open center area that underlies all or the greatest part of the floor, thus to concentrate the ballast below the peripheral flotation member as a further aid to stability.

Ports are provided in the walls of the chamber, the openings of at least the outer wall being continuously open to the flow of water therethrough. In one form of the invention the openings of the inner side wall are check-valved to exhaust air from the center space, creating a partial vacuum that increases the stability of the raft.

6 Claims, 6 Drawing Figures

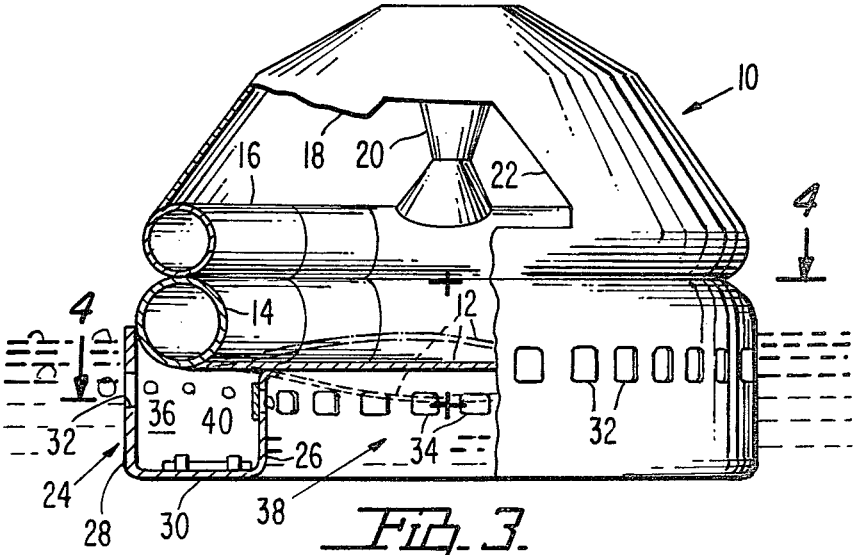
Fig. 3.
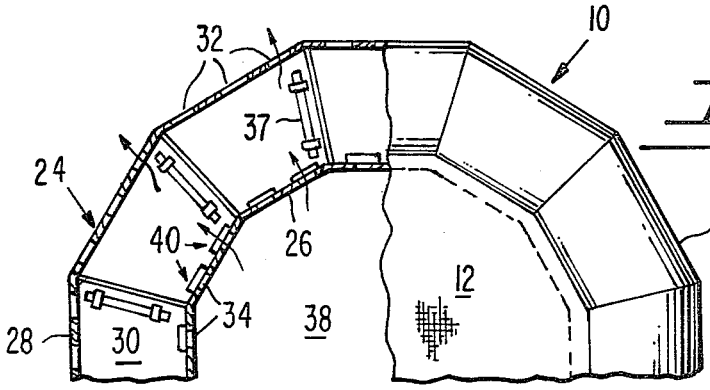
Fig. 4.
Fig. 5.
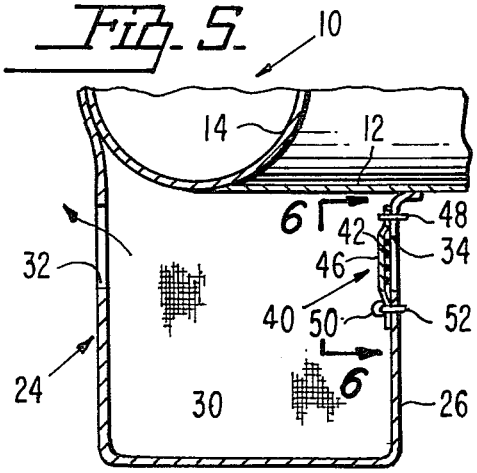
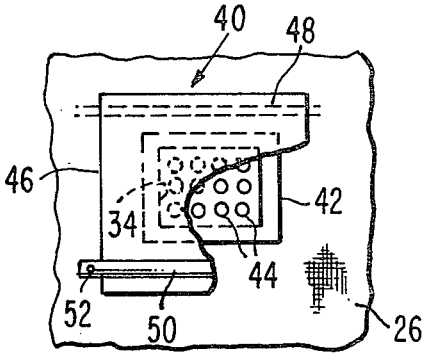
Fig. 6.

LIFE RAFT HAVING A TOROIDAL WATER BALLAST CHAMBER

BACKGROUND OF THE INVENTION a. Field of the Invention

The invention relates to the field of life rafts, especially those of the inflatable type. In a more particular sense the invention relates to those rafts in this general category that are provided with ballast means in the form of water-retaining chambers.

b. Statement of the Prior Art

Water-ballast chambers for rafts of the type described are, in general, old. Heretofore they have been in the form of bags or pockets spaced about the underside of the raft as shown, for example, in U.S. Pat. No. 3,092,854, issued to Manhart on June 11, 1963. Or they have comprised large, centrally disposed enclosures occupying substantially the entire or at least the major portion of the underside of the raft with side walls converging downwardly to be joined to or merge into a bottom wall, as seen for example in U.S. Pat. No. 3,883,913 issued May 20, 1975 to Givens; U.S. Pat. No. 4,001,905 issued Jan. 11, 1977, also to Givens; or U.S. Pat. No. 3,736,607 issued to Radnofsky et al.

Rafts constructed according to the teachings of the Givens and Radnofsky patents have clearly improved stability, but have the disadvantage that they are heavy, cumbersome, difficult to stow, and too expensive. Most importantly, however, they proceed on a theory of improving stability through the provision of a water ballast chamber in the form of a large, depending bag extending across the entire underside of the raft, and indeed having its deepest point directly under the floor. As indicated, such an arrangement may under most circumstances provide improved stability. However, in heavy seas, surf, or high winds, a raft of this design is thought to be highly susceptible to forces that batter the raft both above and below the water surface, as a result of which the raft is likely to be flipped over upon the occupants. In such an event, there is a very real danger of the occupants being crushed. This danger arises because as the raft flips over, the entire contents of the bag crash with great force against the floor of the raft. The contents may comprise thousands of pounds of water. This weight is likely to crush the occupants beneath the floor of the overturned raft. The desirability clearly appears, accordingly, for a raft in which no ballast is carried in the center area, and in which, should the raft overturn, the weight of the water in the ballast chamber will be directed primarily against the inflated flotation element. In these circumstances, no impact is directed against the floor, and the flotation element itself is interposed as a shock absorbent means against which the force of the ballast is directed.

SUMMARY OF THE INVENTION

Summarized briefly, the raft comprising the present invention essentially comprises a flexible floor which may if desired be of the inflatable type, joined at its periphery to an inflatable tube that extends continuously about the floor. Ballast means is provided in the form of a chamber bounding a center space wholly open at its bottom. The chamber depends from and generally parallels the flotation tube, and has an inner series of ports communicating the chamber with the open center space. Outer ports are also provided, and in every form of the invention are continuously open so that the sea water can flow freely into and out of the chamber.

The ports of the inner series, in one form of the invention are filled with check valves. These allow air that is trapped in the open center space to exhaust from the center space into and across the chamber, through the outer ports to atmosphere. The air is exhausted by flexure of the floor under the weight of the occupants and/or the rising and falling of the water level in the open center space as the raft bobs up and down in the water. A bellows-like pumping action is produced by these movements that drives the trapped air through the checkvalves.

As a result, a partial vacuum is created, that causes the ballast chamber to resist movement out of the water and that in effect, causes the raft to adhere or "stick" to the water surface, thus to offer maximum resistance to winds that may otherwise tend to blow under and overturn the raft.

BRIEF DESCRIPTION OF THE DRAWINGS

FIG. 3 is a view like FIG. 1 showing a modified form, the chain-dotted and dash lines showing different positions to which the floor is flexed in normal use;

FIG. 4 is a horizontal sectional view substantially on line 4—4 of FIG. 3;

FIG. 5 is an enlarged, sectional view on the same cutting plane as FIG. 4, showing in greater detail the construction and function of the check-valved air exhaust means; and FIG. 6 is a greatly enlarged, elevational view of one of the check valves, as seen from the line 6—6 of FIG. 5.

DESCRIPTION OF THE PREFERRED EMBODIMENTS

Figure 1:
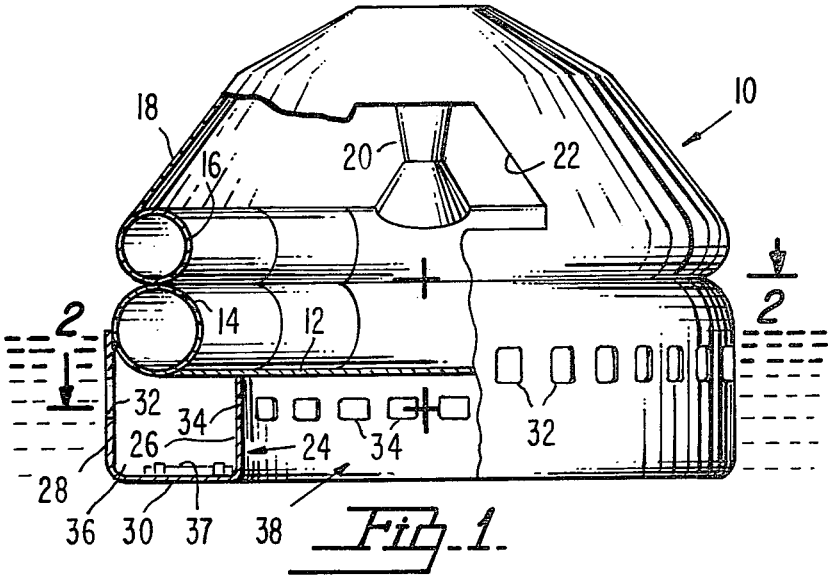
FIG. 1 is a view partly in side elevation and partly in vertical section, through a raft formed according to the present invention.
Figure 2:
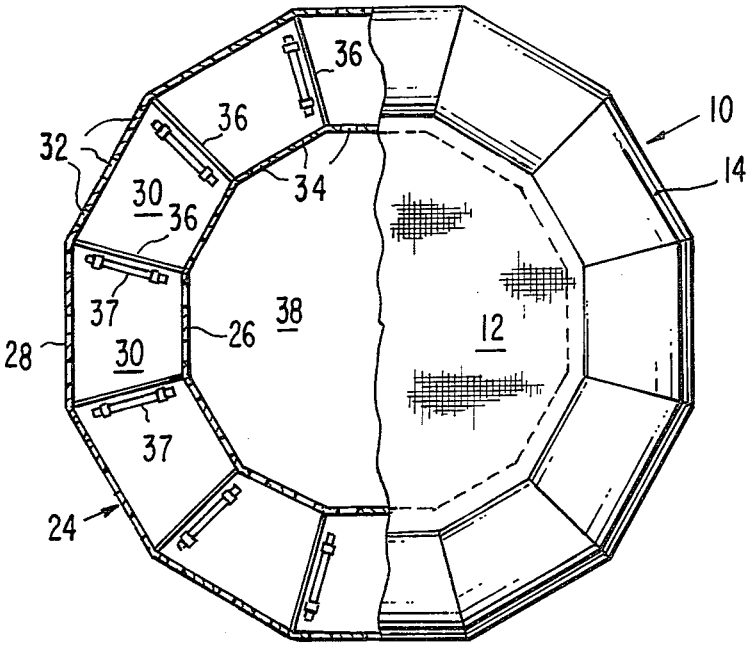
FIG. 2 is a horizontal sectional view substantially on line 2—2 of FIG. 1.

In FIGS. 1 and 2, the raft 10 includes a flexible floor 12 joined permanently at its periphery to the bottom of a continuous, flotation element in the form of an inflatable tube 14 supporting and secured to a correspondingly shaped inflatable gunwale 16, to which is attached the bottom edge of a canopy 18 carried by support posts 20 and having an entrance opening 22. All these parts are conventional. In some forms, the canopy may be omitted; the same is true of the gunwale. Also, the floor 12 may be of the inflatable type. Still further, no attempt is made to illustrate a means for inflating the element 14, gunwale 16, and posts 18; or a compartment for rations and medical supplies; righting straps; or other accessories for sustaining life. The provision of all these is thought sufficiently obvious as not to require special illustration.

In accordance with the invention, a water ballast chamber 24 includes continuous, flexible inner and outer side walls 26, 28 permanently joined along their top edges to the bottom of floor 12 and the outer circumference of flotation element 14, respectively. A flexible bottom wall 30 is sealably, permanently connected along its respective longitudinal edges to the bottom edges of the side walls 26, 28 to provide a depending water ballast chamber which in a preferred embodiment has a width and depth each of which is approximately one-and-one-half the cross-sectional dimension of the element 14 when viewed at any location along the circumference thereof.

Chamber 24 is contiguous to and is preferably directly below the element 14, thus limiting the ballast function to an area directly below and paralleling that at which buoyancy is imparted to the raft by element 14. The desired stabilizing of the raft in heavy seas or winds is thus achieved without detracting in any way from a highly desirable cork-like, bobbing action characteristic of the raft depicted, wherein the raft remains in a general plane paralleling that of the water surface in which it floats, even in the presence of high seas or swells.

To allow the rapid, free flow of water into the chamber 24 when the raft is deployed, there are provided outer and inner series of continuously open flow ports 32, 34 respectively, spaced uniformly and comparatively closely about the entire raft circumference in the inner and outer side walls 26, 28. These open into compartments defined by transverse, flexible partitions 36 secured to walls 26, 28, 30 at uniformly, angularly spaced intervals, and terminating short of the top of the chamber. The compartmentation of the chamber stabilizes the flow of water against any appreciable movement in the direction of the chamber circumference during use, thus promoting retention of a generally even distribution of water within the compartments. The spaces above the partitions do, however, facilitate drainage of the water ballast from the chamber when the raft is pulled out of the water in a rescue operation.

To further aid in deploying the ballast chamber for rapid filling thereof with the water ballast, weights 37 in the form of metal bars or the like may be secured in the bottom of the chamber at uniform angularly spaced intervals.

The chamber 24 bounds an open, bottomless center space 38 the top of which is defined by floor 12. In the form of the invention illustrated in FIGS. 1 and 2, this space can and will fill with water to the extent of the level L of the water around the raft, assuming of course that the floor is at or above said level. If floor 12 is lower than level L, then the space 38 can fill only to the extent permitted by the floor.

In FIGS. 3–6 there is illustrated a modified raft identical in every respect to the raft of FIGS. 1 and 2 except for the provision of check valves 40 controlling flow through the inner series of ports 34. Any of various check valves, including conventional valves available on the open market, are usable. In the illustrated embodiment, however, there has been illustrated a novel valve devised for use in the present invention, including a rubber pad 42 secured within and covering each port 34, having apertures 44 normally closed by a fluid-impervious flexible flap 46 stitched at 48 to wall 26, and having at its lower end a rod-like weight 50 loosely connected at its ends, as at 52, to wall 26 and yieldably biasing the check valve to its normally closed position.

The check valves permit flow only from the space 38 into the chamber 24.

The floor 12 and chamber 24 cooperate to define, in effect, a structure of inverted cup-shaped, bottomless configuration in which air is trapped, on deployment of the raft, similarly to the manner in which air is trapped in a diving bell when it is lowered into the water. The check valve openings are in the upper part of the space 38 near floor 12, so as to communicate with the trapped air. As a result, when the raft occupants move about on the floor, they tend to produce flexure thereof, as for example between the chain-dotted and dash line positions shown in FIG. 4. This tends to compress the air between the floor and the water, causing it to exhaust through the valved openings, across the chamber interior through the water confined therein, and out through the ports 32, which are below the water level L. The air bubbles up through the water surrounding the raft, to atmosphere.

As a result a partial vacuum is created in the space 38. This in turn produces a suction effect in which the adherence of the raft to the water is promoted, that is, the raft is in effect caused to "stick" to the water. This of course is highly desirable, in that a high resistance to overturning of the raft by wave or wind action is developed, adding to the stability offered by the presence of the ballast chamber 24 itself. The operational characteristic is not unlike the suction effect created when one forces an inverted pail into the water and then seeks to pull it out.

In this form of the invention, it may be preferred to have each compartment fully separated from the others by extending the partitions fully to the top of the compartment and sealing off the connection of the partition to the top, sides and bottom of the chamber. This promotes stability but of course makes it somewhat more difficult to pull the raft from the water.

One can, thus, design the raft of FIGS. 1 and 2 for use on smaller, commercial vessels that remain relatively close to the shore line, since it is desired in such cases to save the raft for reuse.

The raft of FIGS. 2–6, on the other hand, may be used to best advantage on vessels or aircraft in which the survivors of a disaster may take to the rafts at great distances from the coast line and may have to await rescue for a long time. In these circumstances, no need or facilities may exist, when rescue arrives, for removal of the raft from the water, after the occupants have been rescued. It follows that in such cases, designing for maximum stability overrides the raft reuse design consideration.

Both forms of the invention, of course, have the same basic characteristic, of having a water ballast chamber mounted to lie contiguous to and directly under a correspondingly toroidal flotation tube. A cork-like action of the raft in heavy seas or high winds is obtained, as a result, as distinguished from a heavy, central, keel-like ballasting extending deep into the water below the floor. The raft of the invention yields to and follows the flow of the swells which it encounters; it does not resist, but rather promotes, a tendency to assume a general plane parallel to the wave surface.

Of importance too is the fact that both forms of the raft deploy quickly, stow in a small space, are of simple, trouble-free design, and by reason of their relatively shallow draft, are particularly resistant to tipping over when brought into shore through heavy surf.

I claim:

1. In a life raft of the type including a floor and a flotation element extending about and joined to the periphery of the floor, the improvement comprising a water ballast chamber that extends about the periphery of the floor in parallel, underlying relation to the flotation element, and that in cooperation with the floor defines a center space wholly open at its bottom and closed at its top by the floor, said ballast chamber defining about said center space a side wall structure that is substantially continuous over the full periphery of the floor and that in cooperation with the floor imparts to the center space an inverted cup shape, the side wall structure formed by the ballast chamber comprising flexible inner and outer side walls each of which has a series of water flow ports circumferentially spaced about the ballast chamber, and comprising additionally a flexible bottom wall closing the chamber at its bottom over the full extent thereof, whereby water entering the chamber through the ports will be retained mainly within an area underlying the flotation element and extending about the open center space, over substantially the full periphery of the floor.

2. The life raft improvement of claim 1 in which the ballast chamber further includes angularly spaced partitions within said chamber extending transversely thereacross to separate the chamber into a series of compartments.

3. The life raft improvement of claim 1 wherein said ports are continuously open to the flow of fluid therethrough.

4. The life raft improvement of claim 1 further including check valves controlling flow through the ports of the inner side wall from the center space into the chamber, and arranged to prevent reverse flow from the chamber into said center space, whereby to exhaust air trapped in said space and create a partial vacuum therein.

5. The life raft improvement of claim 4 wherein the floor is flexible upwardly and downwardly responsive to movement of the occupants of the raft, to pump the trapped air through the check valves.

6. The life raft improvement of claim 1 wherein the ballast chamber and flotation element are in the form of superposed toroids respectively lying in planes below and above the floor substantially in vertical alignment with each other.

* * * * *